US012560350B2

(12) United States Patent
Zhen et al.

(10) Patent No.: US 12,560,350 B2
(45) Date of Patent: Feb. 24, 2026

(54) SWITCHING CONTROL BOARD FOR AIR CONDITIONING SYSTEM, AIR CONDITIONING SYSTEM, AND ADAPTIVE CONTROL METHOD

(71) Applicants: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

(72) Inventors: Jinpeng Zhen, Foshan (CN); Cheng Zhang, Foshan (CN); Zhongzheng Li, Foshan (CN); Weiyou Yu, Foshan (CN); Junya Huo, Foshan (CN); Wenkai Zhang, Foshan (CN)

(73) Assignees: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 377 days.

(21) Appl. No.: 18/033,717

(22) PCT Filed: Jul. 12, 2021

(86) PCT No.: PCT/CN2021/105787

§ 371 (c)(1),
(2) Date: Apr. 25, 2023

(87) PCT Pub. No.: WO2022/127087

PCT Pub. Date: Jun. 23, 2022

(65) Prior Publication Data

US 2023/0332798 A1 Oct. 19, 2023

(30) Foreign Application Priority Data

Dec. 15, 2020 (CN) ..... 202011480577.9

(51) Int. Cl.
*F24F 11/89* (2018.01)
*F24F 1/0003* (2019.01)
(Continued)

(52) U.S. Cl.
CPC ..... *F24F 11/89* (2018.01); *F24F 1/0003* (2013.01); *F24F 11/56* (2018.01); *F24F 11/88* (2018.01)

(58) Field of Classification Search
CPC ..... F24F 1/0003; F24F 11/30; F24F 11/49; F24F 11/54; F24F 11/56; F24F 11/88; F24F 11/89; F24F 2140/10
See application file for complete search history.

(56) References Cited

U.S. PATENT DOCUMENTS 6,126,080 A * 10/2000 Wada ..... F24F 11/30 165/207
2015/0008762 A1* 1/2015 Higashiyama ..... F24F 1/20 307/113

(Continued)

FOREIGN PATENT DOCUMENTS

CN 106524421 A 3/2017
CN 108592349 A 9/2018

(Continued)

OTHER PUBLICATIONS

The European Patent Office (EPO) Extended Search Report for EP Application No. 21905020.0 Mar. 19, 2024 12 Pages.

(Continued)

*Primary Examiner* — Tameem D Siddiquee
(74) *Attorney, Agent, or Firm* — Anova Law Group, PLLC

(57) ABSTRACT

A switching control board includes an outdoor unit communication module configured to establish a communication (Continued)

connection between the switching control board and an outdoor unit of an air conditioning system, a detection module configured to detect a type of an indoor device of the air conditioning system that is connected to the switching control board, and a control module connected to the outdoor unit communication module and the detection module. The control module is configured to obtain a control parameter based on the type of the indoor device and send the control parameter to the outdoor unit via the communication connection between the switching control board and the outdoor unit to control the outdoor unit.

14 Claims, 4 Drawing Sheets

(51) Int. Cl.
*F24F 11/56* (2018.01)
*F24F 11/88* (2018.01)

(56) References Cited

U.S. PATENT DOCUMENTS

| | | | | |
|---|---|---|---|---|
| 2019/0346166 | A1 | 11/2019 | Koizumi et al. | |
| 2020/0041967 | A1* | 2/2020 | Shrivastava | G02F 1/163 |

FOREIGN PATENT DOCUMENTS

| | | | |
|---|---|---|---|
| CN | 105318488 | B | 7/2019 |
| CN | 110762777 | A | 2/2020 |
| CN | 112556131 | A | 3/2021 |
| ES | 2248150 | T3 | 3/2006 |
| JP | 2019066106 | A | 4/2019 |

OTHER PUBLICATIONS

The World Intellectual Property Organization (WIPO) International Search Report for PCT/CN2021/105787 Sep. 30, 2021 6 Pages (including translation).

The China National Intellectual Property Administration (CNIPA) The First Office Action for Chinese Application 202011480577.9 Sep. 28, 2021 15 Pages (With Translation).

The China National Intellectual Property Administration (CNIPA) The Notification to Grant Patent Right for Invention for Chinese Application 202011480577.9 Mar. 3, 2022 7 Pages (With Translation).

* cited by examiner

SWITCHING CONTROL BOARD FOR AIR CONDITIONING SYSTEM, AIR CONDITIONING SYSTEM, AND ADAPTIVE CONTROL METHOD

CROSS-REFERENCE TO RELATED APPLICATIONS

The present application is a National Stage Entry under 35 U.S.C. § 371 of International Application No. PCT/CN2021/105787, filed on Jul. 12, 2021, which is submitted based on and claims priority to Chinese Patent Application No. 202011480577.9, filed on Dec. 15, 2020, the entire disclosures of which are incorporated herein by reference.

FIELD

The present disclosure relates to the technical field of home appliance manufacturing, and more particularly, to a switching control board for an air conditioning system, an air conditioning system having the switching control board, and an adaptive control method for the air conditioning system.

BACKGROUND

In the related art, an indoor unit and an outdoor unit of an air conditioner complete indoor and outdoor data interaction in accordance with an agreed protocol, and parameters such as a frequency of a compressor of the outdoor unit are controlled based on indoor and outdoor temperatures, a user set mode, a wind speed and other parameters, to operate the entire system. This raises a relatively high requirement on the specific association between the indoor unit and the outdoor unit. Therefore, the outdoor unit and the indoor unit must be synchronously replaced and developed, which results in an excessively high design cost and a challenge for improvement.

SUMMARY

An object of the present disclosure is to provide a switching control board for an air conditioning system, through which an outdoor unit is not required to be pared with an indoor unit for use, reducing use limitation of the outdoor unit and further reducing development cost of an air conditioner.

In the switching control board for the air conditioning system according to embodiments of the present disclosure, the switching control board is disposed between an outdoor unit of the air conditioning system and an indoor device of the air conditioning system. The switching control board includes: an outdoor unit communication module configured to establish a communication connection between the switching control board and the outdoor unit; a detection module configured to detect a type of the indoor device connected to the switching control board; and a control module connected to the outdoor unit communication module and the detection module, the control module being configured to obtain a corresponding control parameter based on the type of the indoor device. The corresponding control parameter is sent to the outdoor unit via the communication connection between the switching control board and the outdoor unit, to control the outdoor unit.

In the switching control board for the air conditioning system according to the embodiments of the present disclosure, since the switching control board provides a control connection between the outdoor unit and the indoor device, the outdoor unit is not required to perform information interaction with the indoor device based on a fixed communication protocol. In this way, the use of the outdoor unit is not limited by a specific model of the indoor unit, and development and use cost of the outdoor unit can be reduced, improving flexibility in use of the outdoor unit and broadening application range thereof.

In the switching control board for the air conditioning system according to the embodiments of the present disclosure, the detection module includes: a voltage detection unit configured to detect a voltage parameter of the indoor device to generate a voltage detection signal; and an indoor communication unit configured to establish a communication connection between the switching control board and the indoor device. The detection module is configured to: determine, in response to determining based on the voltage detection signal that the voltage parameter of the indoor device satisfies a predetermined condition, the indoor device to be a wired controller; and determine the indoor device to be an indoor unit based on communication information between the indoor communication unit and the indoor device.

In the switching control board for the air conditioning system according to the embodiments of the present disclosure, the control module is further configured to, in response to determining that the indoor device is the wired controller: determine a target pressure based on a control instruction sent by the wired controller detect a current system pressure of the air conditioning system; determine an operating parameter of the outdoor unit based on the current system pressure and the target pressure; and send the operating parameter of the outdoor unit to the outdoor unit via the communication connection between the switching control board and the outdoor unit.

In the switching control board for the air conditioning system according to the embodiments of the present disclosure, the control module is further configured to, in response to determining that the indoor device is the indoor unit: receive, via the communication connection between the switching control board and the indoor unit, an operating parameter of the outdoor unit sent by the indoor unit; and forward the operating parameter of the outdoor unit to the outdoor unit via the communication connection between the switching control board and the outdoor unit.

Another object of the present disclosure is to provide an air conditioning system.

The air conditioning system according to the present disclosure includes the switching control board for the air conditioning system according to any one of the above-mentioned embodiments.

Yet another object of the present disclosure is to provide an adaptive control method for an air conditioning system.

In the adaptive control method for the air conditioning system according to the embodiments of the present disclosure, the method is applied to a switching control board disposed between an outdoor unit of the air conditioning system and an indoor device of the air conditioning system and including an outdoor unit communication module. The method includes: establishing, by the outdoor unit communication module, a communication connection between the switching control board and the outdoor unit; detecting a type of the indoor device connected to the switching control board; and obtaining a corresponding control parameter based on the type of the indoor device, and sending the corresponding control parameter to the outdoor unit via the communication connection between the switching control board and the outdoor unit, to control the outdoor unit.

In the adaptive control method for the air conditioning system according to the embodiments of the present disclosure, said detecting the type of the indoor device connected to the switching control board includes: detecting a voltage parameter of the indoor device to generate a voltage detection signal; and determining, in response to determining based on the voltage detection signal that the voltage parameter of the indoor device satisfies a predetermined condition, the indoor device to be a wired controller.

In the adaptive control method for the air conditioning system according to the embodiments of the present disclosure, said obtaining the corresponding control parameter based on the type of the indoor device includes, in response to determining that the indoor device is the wired controller: determining a target pressure based on a control instruction sent by the wired controller; detecting a current system pressure of the air conditioning system; and determining an operating parameter of the outdoor unit based on the current system pressure and the target pressure.

In the adaptive control method for the air conditioning system according to the embodiments of the present disclosure, the switching control board further includes an indoor communication unit, and said detecting the type of the indoor device connected to the switching control board includes: establishing, by the indoor communication unit, a communication connection between the switching control board and the indoor device; receiving, based on the communication connection between the switching control board and the indoor device, communication information sent by the indoor device; and determining the indoor device to be an indoor unit based on the communication information.

In the adaptive control method for the air conditioning system according to the embodiments of the present disclosure, the method further includes, in response to determining that the indoor unit is an indoor unit: receiving, via the communication connection between the switching control board and the indoor device, an operating parameter of the outdoor unit sent by the indoor unit; and forwarding the operating parameter of the outdoor unit to the outdoor unit via the communication connection between the switching control board and the outdoor unit.

Still yet another object is to provide a computer-readable storage medium, having stored thereon an adaptive control program for an air conditioning system. The adaptive control program for the air conditioning system, when executed by a processor, implements the adaptive control method for the air conditioning system according to any one of the embodiments described above.

Still yet another object is to provide another switching control board. The switching control board includes: a memory; a processor; and an adaptive control program for an air conditioning system stored in the memory and executable by the processor. The processor, when executing the adaptive control program for the air conditioning system, implements the adaptive control method for the air conditioning system according to any one of the embodiments described above.

Additional aspects and advantages of the embodiments of present disclosure will be provided at least in part in the following description, or they will become apparent at least in part from the following description, or they can be learned from practicing the embodiments of the present disclosure.

BRIEF DESCRIPTION OF THE DRAWINGS

The above-mentioned and/or additional aspects and advantages of embodiments of the present disclosure will become apparent and more readily appreciated from the following descriptions made with reference to the accompanying drawings, in which.

Figure 1:
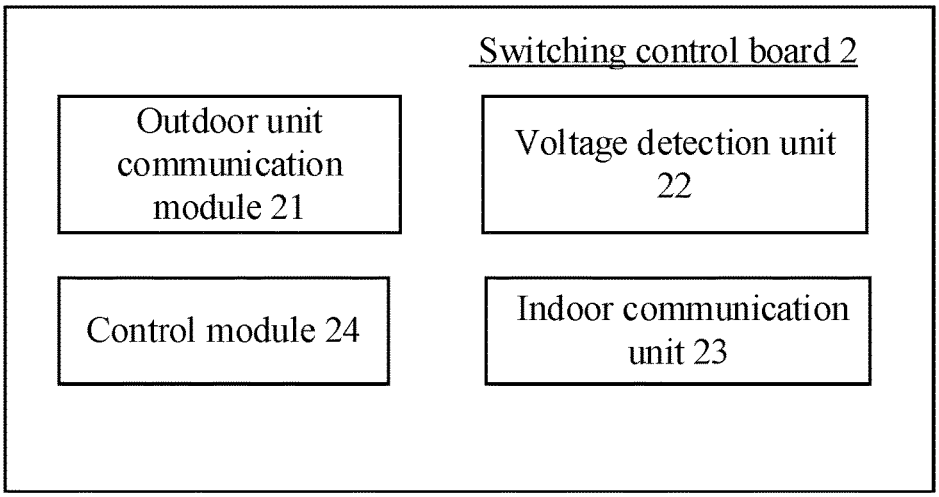
FIG. 1 is a schematic structural diagram of a switching control board according to an embodiment of the present disclosure.

REFERENCE NUMERALS air conditioning system 100, outdoor unit 1, switching control board 2, outdoor unit communication module 21, voltage detection unit 22, indoor communication unit 23, control module 24, indoor unit 3, wired controller 4.

DETAILED DESCRIPTION

The embodiments of the present disclosure will be described in detail below. The embodiments are illustrated in the accompanying drawings, throughout which same or similar elements, or elements having same or similar functions are denoted with same or similar reference numerals. The embodiments described below with reference to the drawings are illustrative only, and they are merely intended to explain, rather than limiting, the present disclosure.

The following description provides a number of embodiments or examples for implementing different structures of the present disclosure. To simplify the description, components and arrangements of particular examples will be described below, which are, of course, examples only and are not intended to limit the present disclosure. Furthermore, reference numerals and/or letters may be repeated in different examples. Such repetition is for the purpose of simplicity and clarity and does not indicate any relationship between various embodiments and/or arrangements. In addition, various examples of specific processes and materials are provided in the present disclosure. However, those skilled in the art may be aware of applications of other processes and/or the use of other materials.

Figure 2:
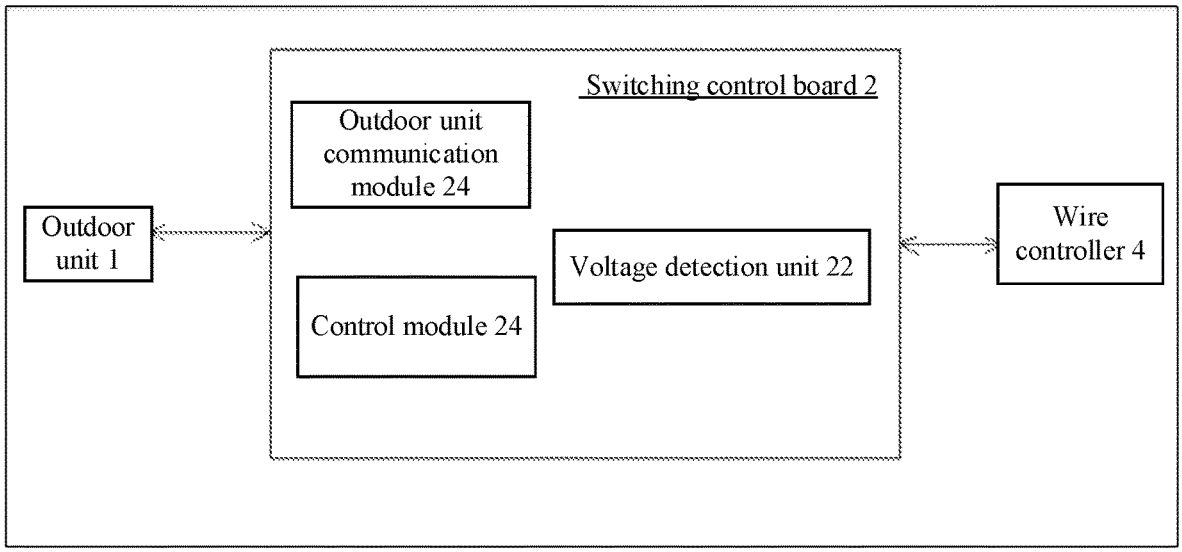
FIG. 2 is a schematic diagram showing a connection of an air conditioning system according to an embodiment of the present disclosure (an indoor device is a wired controller).
Figure 3:
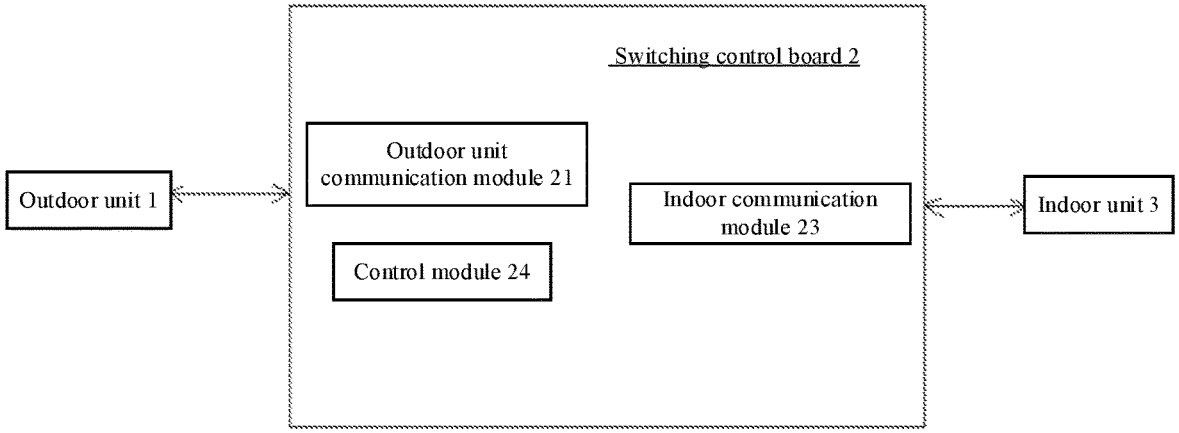
FIG. 3 is a schematic diagram showing a connection of an air conditioning system according to an embodiment of the present disclosure (an indoor device is an indoor unit).

With reference to FIG. 1 to FIG. 3, a switching control board 2 for the air conditioning system according to the embodiments of the present disclosure is described below. The switching control board 2 can connect an outdoor unit 1 with an indoor device of different types, such that practical use and replacement of the outdoor unit 1 are not limited by the type of the indoor device, reducing usage and development cost of the outdoor unit 1.

Firstly, in the switching control board 2 for the air conditioning system according to the present disclosure, the switching control board 2 is disposed between the outdoor unit 1 of an air conditioning system 100 and the indoor device. The outdoor unit 1 is installed in outdoor space, while the indoor device is installed in indoor space. The indoor device may be an existing indoor unit 3 in the indoor space or a separate indoor control device of the air conditioning system 100. For example, the indoor device is a wired controller 4.

As illustrated in FIG. 1, the switching control board 2 for the air conditioning system according to the embodiments of the present disclosure includes an outdoor unit communication module 21, a detection module, and a control module 24.

The outdoor unit communication module 21 is configured to establish a communication connection between the switching control board 2 and the outdoor unit 1. The outdoor unit communication module 21 may be a built-in communication element of the switching control board 2 and used for information and data transmission between the switching control board 2 and the outdoor unit 1. The outdoor unit communication module 21 may be in communication connection with the outdoor unit 1 via a wired connection or via a wireless connection. Thus, a control signal generated in the switching control board 2 can be outputted to the outdoor unit 1 to ensure that the outdoor unit 1 can be accurately and effectively controlled. After a specific target frequency of a compressor of the outdoor unit 1 and an opening degree of an expansion valve of the outdoor unit 1 are generated or determined in the switching control board 2, related parameter information can be outputted by the outdoor unit communication module 21 to the outdoor unit 1, to enable the outdoor unit 1 to operate in accordance with a target requirement.

The detection module is configured to detect a type of the indoor device connected to the switching control board 2. That is, during the establishment of the control connection between the outdoor unit 1 and the indoor device, the detection module may be first electrically connected to the indoor device to detect an operating mode, a pressure requirement, and a startup signal of the indoor unit 3, facilitating adaptively determining the operating parameter of the outdoor unit 1 based on the type of the indoor device.

The control module 24 is connected to the outdoor unit communication module 21 and the detection module. A corresponding control parameter is obtained by the control module 24 based on the type of the indoor device, and the corresponding control parameter is sent to the outdoor unit via the communication connection between the switching control board 2 and the outdoor unit 1 to control the outdoor unit 1.

That is, in the present disclosure, by providing the switching control board 2 between the outdoor unit 1 and the indoor device, when the outdoor unit 1 is connected to an indoor device of different types, the type of the indoor device to be connected can be detected by the detection module, to flexibly and adaptively match the control parameter and the related target information required by the outdoor unit 1 corresponding to the indoor device based on the determined type of the indoor device. Therefore, the control information correspondingly generated is outputted by the outdoor unit communication module 21 to the outdoor unit 1.

Hence, without requiring the information interaction between the outdoor unit 1 and the indoor device based on a fixed communication protocol, a control connection between the same outdoor unit 1 and any indoor devices of different types can be established. In this way, during the practical use of the outdoor unit 1, attributed to the reduced the limitations in use and development of the outdoor unit 1 caused by the adaptation requirement of the indoor unit 3, the switching control board 2 according to the present disclosure adapts the outdoor unit 1 to an indoor device of any type by merely replacing one outdoor unit 1. Therefore, the development requirement and cost of the outdoor unit 1 are reduced, and use flexibility of the outdoor unit 1 is improved.

In the switching control board 2 for the air conditioning system according to the embodiments of the present application, attributed to the control connection between the outdoor unit 1 and the indoor device through the switching control board 2, the outdoor unit 1 is not required to perform information interaction with the indoor device based on a fixed communication protocol, thereby reducing the use limitations of the outdoor unit 1 caused by a specific model of the indoor unit 3 and lowering development and use cost of the outdoor unit 1, and improves use flexibility of the outdoor unit 1 to have a wider application range.

In some embodiments, as illustrated in FIG. 1, the detection module includes a voltage detection unit 22 and an indoor communication unit 23. The voltage detection unit 22 is configured to detect a voltage parameter of the indoor device to generate a voltage detection signal, and the indoor communication unit 23 is configured to establish a communication connection between the switching control board 2 and the indoor device.

The detection module is configured to determine, when it is determined based on the voltage detection signal that the voltage parameter of the indoor device satisfies a predetermined condition, the indoor device to be a wired controller 4. That is, as illustrated in FIG. 2, the switching control board 2 according to the present disclosure can connect the wired controller 4 with the outdoor unit 1. In this case, the wired controller 4 and the voltage detection unit 22 cooperate with each other via a non-communication connection, such that an instruction for controlling the outdoor unit 1 can be flexibly generated by the switching control board 2 based on an operating mode, a pressure requirement and a startup signal of the wired controller 4, thereby controlling the outdoor unit 1. A voltage parameter of the wired controller 4 can be obtained by the voltage detection unit 22, and an operating parameter of the corresponding outdoor unit 1 can be determined based on the voltage parameter of the wired controller 4. For example, when the voltage detection unit 22 determines that the wired controller 4 is a 24V wired controller 4, the switching control board 2 can adaptively output an operating information instruction for controlling the outdoor unit 1 based on a 24V startup signal sent by the wired controller 4.

It should be noted that the wired controller 4 has a control interface, on which the user can manually set an operating mode, an operating temperature and other operating parameters of the air conditioner, for example, inputting that the air conditioner is started up in a refrigeration mode, and setting the operating temperature of the air conditioner at 26° C. and a wind speed of the air conditioner to be 60%. The wired controller 4 can determine based on information such as an indoor ambient temperature and the set temperature whether the outdoor unit 1 should be turned on. For example, when the indoor ambient temperature is 30° C., the set temperature is 26° C., and the indoor unit 3 is required to perform cooling, the wired controller 4 sends the startup signal to the switching control board 2, enabling the switching control board 2 to generate the operating information instruction for controlling the outdoor unit 1 based on the corresponding set parameters. In this way, the outdoor unit 1 and the wired controller 4 can be adapted to each other.

The switching control board 2 can obtain system information of the outdoor unit 1 by mean of the outdoor unit communication module 21, for example, an outdoor ambient temperature, an outdoor gas exhaust pipe temperature and other parameters, to accurately control the outdoor unit 1 through integrating the outdoor unit 1 and the indoor device. In this way, the switching control board 2 can simulate the indoor unit 3 to send the target frequency to the outdoor unit 1, and the outdoor unit 1 operates based on the target frequency, coordinately controlling a rotating speed of a fan of the outdoor unit 1 based on the target frequency.

In addition, it is determined based on communication information between the communication module 23 and the indoor device that the indoor device is an indoor unit 3. That is, as illustrated in FIG. 3, the switching control board 2 of the present disclosure can also connect the existing indoor unit 3 with the outdoor unit 1. Thus, the switching control board 2 can adaptively generate an instruction for controlling the outdoor unit 1 based on an ambient temperature, a set temperature, a wind speed and other important parameters of the indoor unit 3 as well as a specification type of the indoor unit 3, thereby controlling of the outdoor unit 1. When the indoor unit 3 is in communication connection with the outdoor unit 1 via the indoor communication unit 23, the indoor communication unit 23 can receive the control instruction sent by the indoor unit 3 and other information of the indoor unit 3, for example, key parameters including startup or shutdown, an operating mode, and an indoor temperature. The indoor unit 3 may be a 485 indoor unit.

It should be noted that, if the indoor unit 3 is in a wireless communication connection with a remote controller of the air conditioner, when the user is performing startup and operating control on the indoor unit 3, the indoor unit 3 can receive communication information including the user's instruction and then output it to the indoor communication unit 23. The communication information is received by the indoor communication unit 23, to enable the switching control board 2 to generate specific control information for the outdoor unit 1, thereby controlling of the outdoor unit 1.

In some embodiments, when the indoor device is the wired controller 4, the control module 24 is further configured to: determine a target pressure based on a control instruction sent by the wired controller 4; detect a current system pressure of the air conditioning system 100; determine an operating parameter of the outdoor unit 1 based on the current system pressure and the target pressure; and send the operating parameter of the outdoor unit 1 to the outdoor unit 1 via the communication connection between the switching control board 2 and the outdoor unit 1.

That is, when the outdoor unit 1 is controlled by the wired controller 4 through the switching control board 2, the corresponding temperature requirement and mode requirement are inputted by the user through the control interface of the online controller 4, and the wired controller 4 outputs the corresponding mode requirement and capability requirement to the switching control board 2 through control information transmission by means of connection wires. Thus, the target pressure of the air conditioning system 100 can be determined by the control module 24. In the meantime, a current operating pressure value of the air conditioning system 100 is detected. For example, a current system pressure of the air conditioning system 100 is obtained in real time by providing a pressure sensor, and the specific operating parameter such as the operating frequency required for achieving the target pressure of the outdoor unit 1 is calculated based on the parameter values of the two pressures. Therefore, the outdoor unit 1 can be accurately and appropriately controlled, to ensure that the operation of the outdoor unit 1 can meet use requirements of the user.

Figure 6:
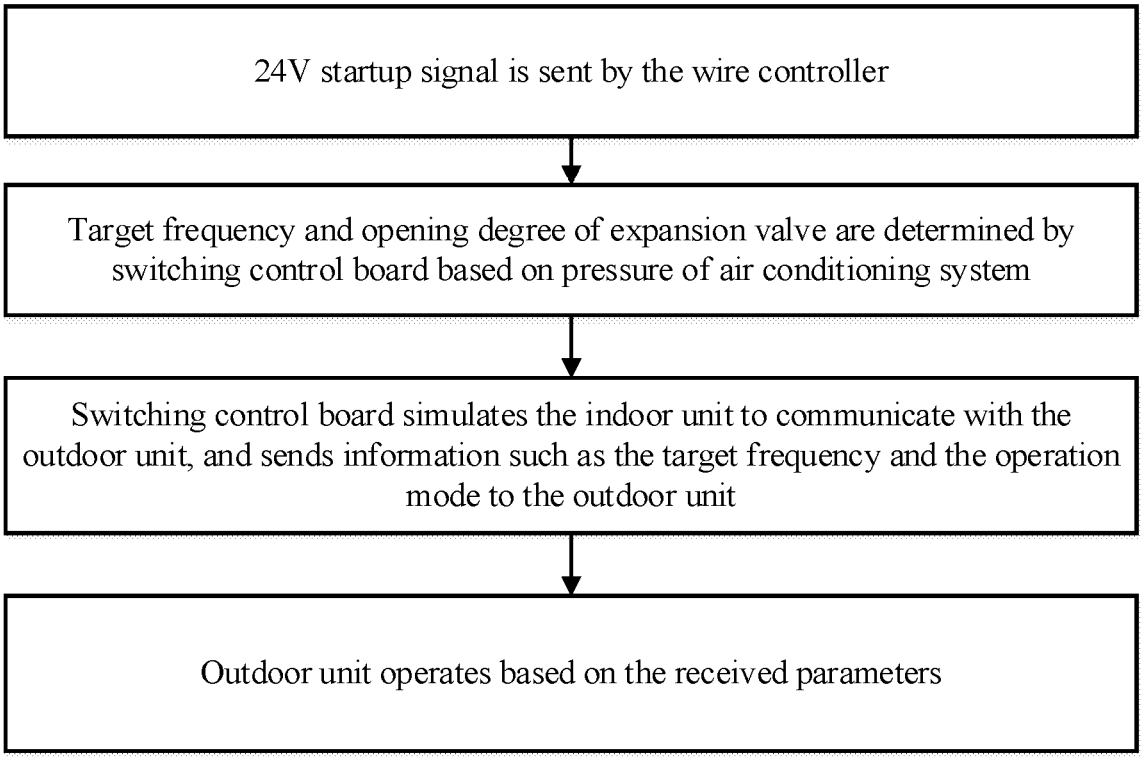
FIG. 6 is a flowchart of an adaptive control method for an air conditioning system in a non-communication mode according to an embodiment of the present disclosure.

Hence, when the wired controller 4 and the switching control board 2 cooperate with each other via the non-communication connection, and when the key parameters of the indoor unit 3 such as the ambient temperature, set temperature, and wind speed cannot be obtained, the parameters such as the frequency of the compressor and the opening degree of the expansion valve can be controlled by the pressure sensor. In this way, the control is more accurate, and operation reliability and user's comfort level are improved. That is, as illustrated in FIG. 6, in the non-communication operating mode, the wired controller 4 can send the 24V startup signal, and the switching control board 2 can determine the target frequency and the opening degree of the expansion valve based on the current pressure of the air conditioning system 100 detected by the pressure detection module. The target pressure is determined based on an outdoor environment and an energy demand of the wired controller 4. The target frequency is dynamically adjusted based on a difference between the target pressure and an actual pressure. The switching control board 2 simulates the indoor unit 3 to communicate with the outdoor unit 1 and sends information such as the target frequency and the operating mode to the outdoor unit 1, and the outdoor unit 1 operates based on the received parameters.

In some embodiments, when the indoor device is the indoor unit 3, the control module 24 is further configured to: receive, via the communication connection between the adapter control board 2 and the indoor unit 3, the operating parameter of outdoor unit 1 sent by the indoor unit 3; and forward the operating parameter of the outdoor unit 1 to the outdoor unit 1 via the communication connection between the adapter control board 2 and the outdoor unit 1.

That is, information of the indoor unit 3 such as the set information and the target frequency information can be outputted by the indoor communication unit 23 to the switching control board 2. In some embodiments, the key parameters such as startup and shutdown signals, the target mode, and the set temperature can be outputted to the switching control board 2. Therefore, when the indoor unit 3 and the outdoor unit 1 perform information interaction therebetween through the switching control board 2, the target operating parameter of the outdoor unit 1 can be outputted from the indoor unit 3 to the switching control board 2 through the indoor communication unit 23, and thus the target operating parameter of the outdoor unit 1 can be outputted from the switching control board 2 to the outdoor unit 1 through the outdoor unit communication module 21. In this way, after the outdoor unit receives the target operating parameter, i.e., after the outdoor unit 1 is switched into an operating state that the outdoor unit 1 operates based on the target operating parameter, the accurate control of the outdoor unit 1 is realized.

Figure 7:
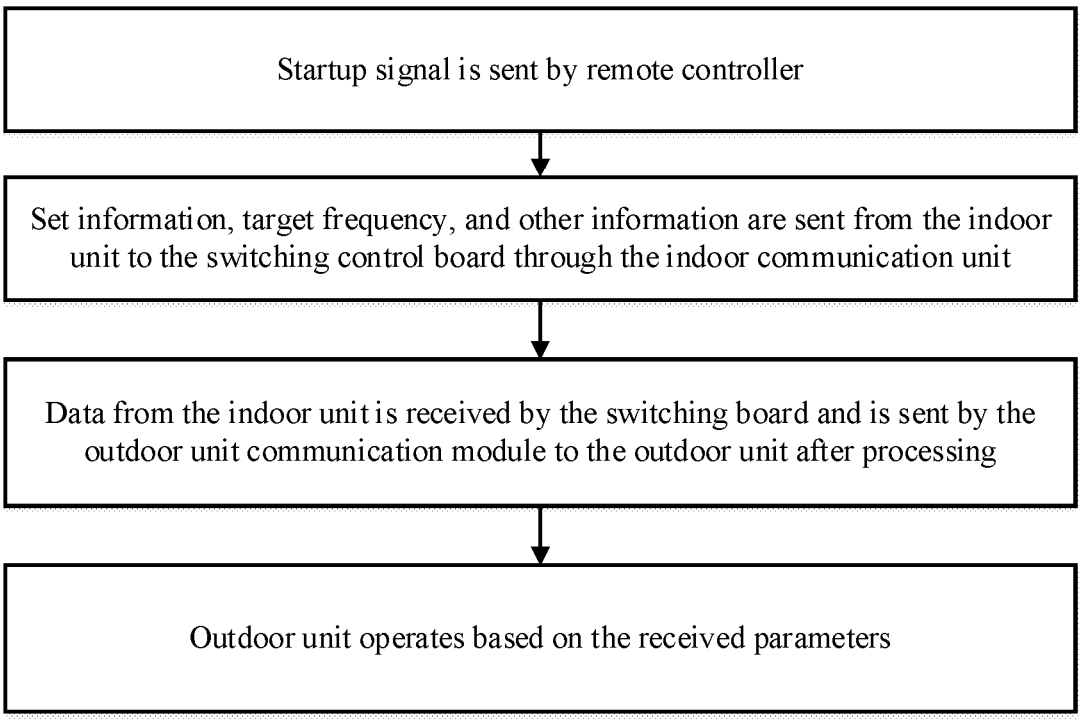
FIG. 7 is a flowchart of an adaptive control method for an air conditioning system in a communication mode according to an embodiment of the present disclosure.

In the specific performing process, as illustrated in FIG. 7, the user may send the startup signal and set the operating parameter of the air conditioner through an indoor controller or a remote controller, e.g., turning the air conditioner on in the refrigeration mode, and setting the operating temperature of the air conditioner at 26° C. and the wind speed to be 60%. After receiving the signal from the wired controller 4 or the remote control, the indoor unit 3 operates at the set wind speed based on the control requirements, and confirms the operating frequency of the outdoor unit 1 based on the set value, and further the indoor unit 3 sends the indoor mode, the indoor temperature, the indoor target frequency to the switching control board 2. For example, the indoor unit 3 sends the set information and target frequency to the switching control board 2 through the indoor communication unit 23. After receiving and processing the data from the indoor unit 3, the switching control board 2 simulates the indoor unit 3 to send the target frequency to the outdoor unit 1. The outdoor unit 1 operates based on the target frequency, coordinately controlling a rotating speed of an outdoor fan based on the frequency.

Another object of the present disclosure is to provide an air conditioning system 100.

The air conditioning system 100 according to the embodiments of the present disclosure includes the switching control board 2 for the air conditioning system according to any one of the embodiments described above. Since the switching control board 2 provides the control connection between the outdoor unit and the indoor device, the outdoor unit 1 is not required to perform the information interaction with the indoor device based on the fixed communication protocol. In this way, the use of the outdoor unit is not limited by a specific model of the indoor unit, and development and use cost of the outdoor unit can be reduced, improving flexibility in use of the outdoor unit and broadening application range thereof.

Yet another object of the present disclosure is to provide an adaptive control method for an air conditioning system 100.

In the adaptive control method of the air conditioning system 100 according to the embodiments of the present disclosure, the adaptive control method is applied to a switching control board 2 disposed between an outdoor unit 1 of the air conditioning system 100 and an indoor device of the air conditioning system 100. The switching control board 2 includes an outdoor unit communication module 21. The adaptive control method includes the following actions at the following blocks.

Figure 4:
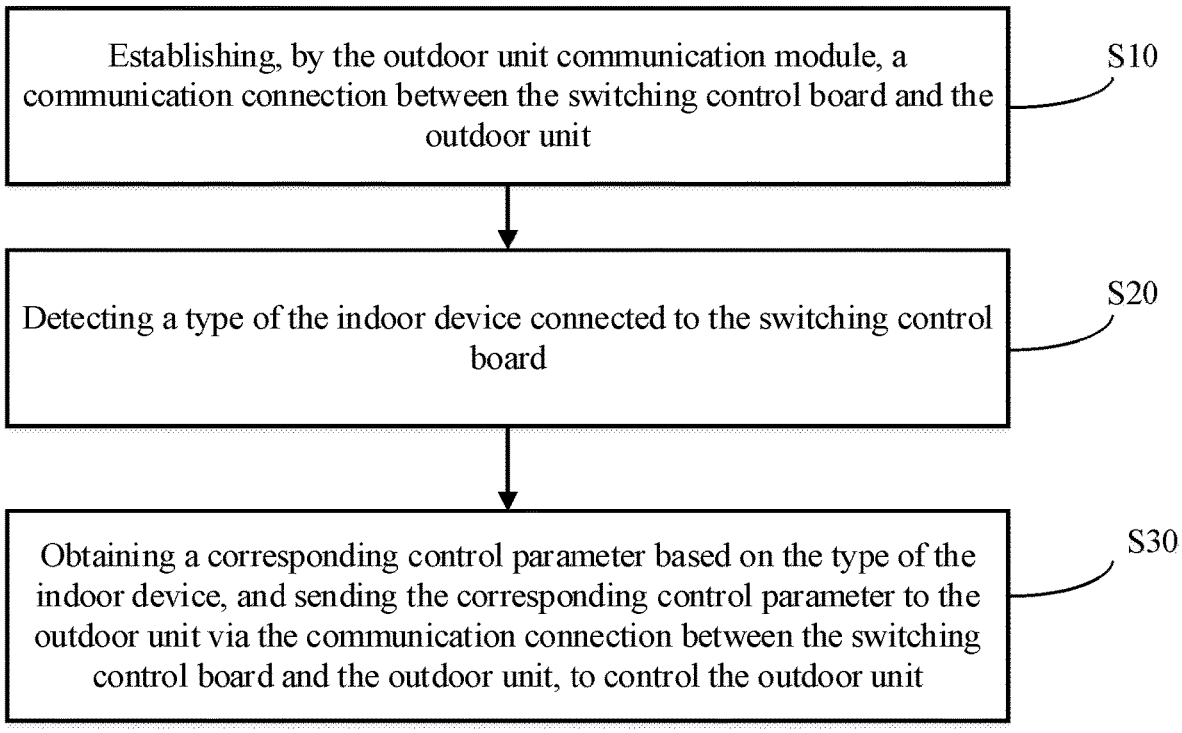
FIG. 4 is a schematic flowchart of an adaptive control method for the air conditioning system according to an embodiment of the present disclosure.

As illustrated in FIG. 4, at bock S10, a communication connection between the switching control board and the outdoor unit is established by the outdoor unit communication module. In some embodiments, a communication element may be integrated on the switching control board 2 to serve as the outdoor unit communication module 21 for information and data transmission between the switching control board 2 and the outdoor unit 1. The outdoor unit communication module 21 may be in a communication connection with the outdoor unit 1 via a wired connection or via a wireless connection. Thus, the control signal generated in the switching control board 2 can be outputted to the outdoor unit 1 to ensure that the outdoor unit 1 can be accurately and effectively controlled. After the specific target frequency of the compressor the outdoor unit 1 and the opening degree of the expansion valve of the outdoor unit 1 are generated or determined in the switching control board 2, the related parameter information can be outputted by the outdoor unit communication module 21 to the outdoor unit 1, to enable the outdoor unit 1 to operate in accordance with a target requirement.

Figure 5:
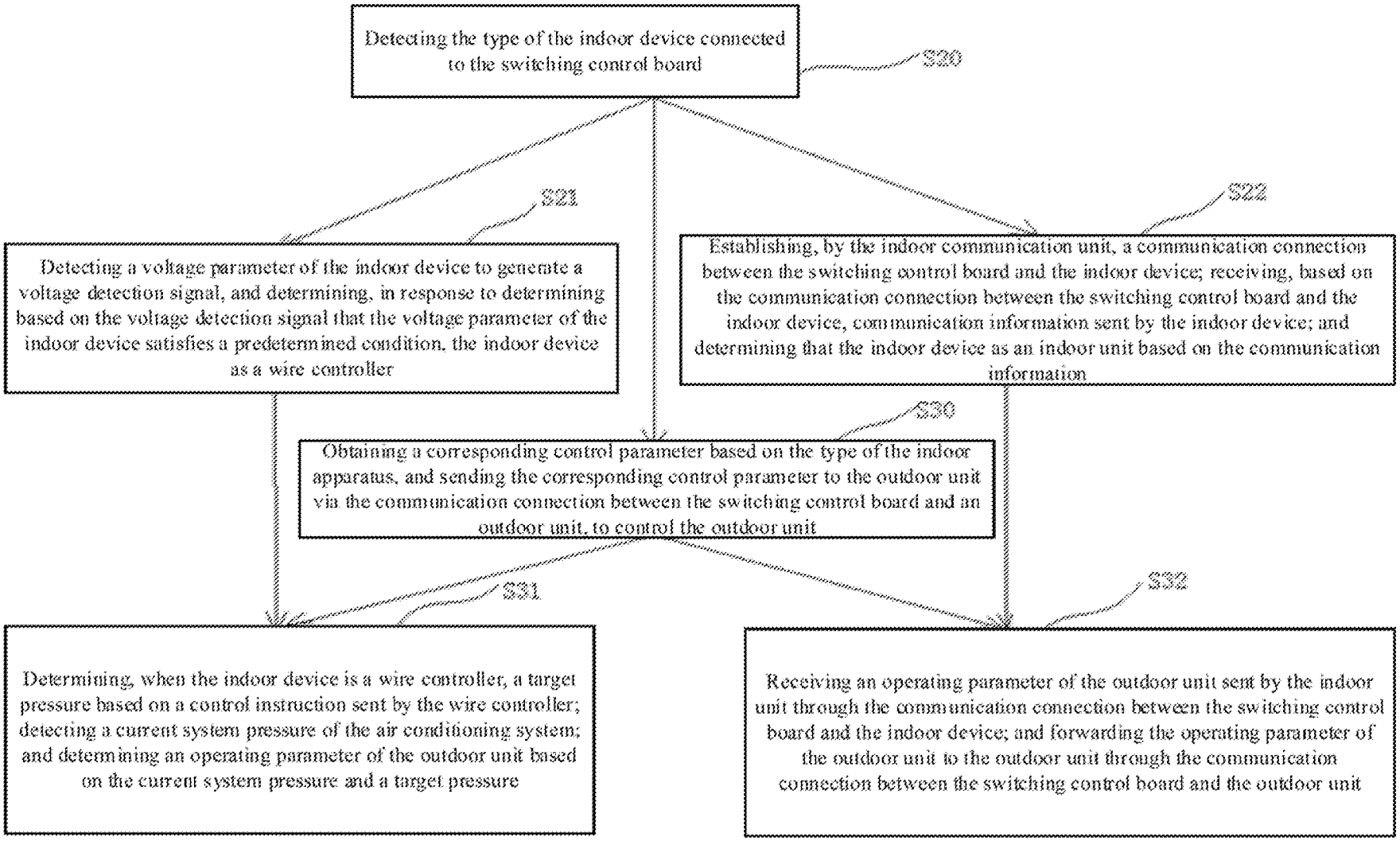
FIG. 5 is a specific flowchart of an adaptive control method for the air conditioning system according to an embodiment of the present disclosure.

As illustrated in FIG. 4 and FIG. 5, at block S20, the type of the indoor device connected to the switching control board 2 is detected.

It should be noted that the indoor device includes the indoor unit 3 and the wired controller 4. For different types of the indoor devices, the switching control board 2 outputs different control instructions to the outdoor unit 1 to adapt to different operating modes of the outdoor unit 1. Therefore, by determining the specific type of the indoor device at block S20, it can be ensured that the switching control board 2 can more accurately and properly output the corresponding indoor device in combination with the type of the indoor device, and it can also be ensured that the outdoor unit 1 can adapt to different indoor devices.

As illustrated in FIG. 4 and FIG. 5, at block S30, a corresponding control parameter is obtained based on the type of the indoor device, and the corresponding control parameter is sent to the outdoor unit 1 via the communication connection between the switching control board 2 and the outdoor unit 1 to control the outdoor unit 1.

Therefore, after the action of block S30 is performed, the control parameter and related target information required by the outdoor unit 1 corresponding to the indoor device can be flexibly and adaptively matched based on the determined type of the indoor device, and the correspondingly generated control information is outputted to the outdoor unit 1 through the outdoor unit communication module 21.

Hence, without requiring the information interaction between the outdoor unit 1 and the indoor device based on a fixed communication protocol, a control connection between the same outdoor unit 1 and any indoor devices of different types can be established. In this way, during the practical use of the outdoor unit 1, attributed to the reduced limitations in use and development of the outdoor unit 1 caused by the adaptation requirement of the indoor unit 3, the switching control board 2 according to the present disclosure adapts the outdoor unit 1 to an indoor device of any type by merely replacing one outdoor unit 1. Therefore, the development requirement and cost of the outdoor unit 1 are reduced, and use flexibility of the outdoor unit 1 is improved.

In some embodiments, as illustrated in FIG. 5, the action at block S20 of detecting the type of the indoor device connected to the switching control board 2 includes: the action at block S21 of detecting a voltage parameter of the indoor device to generate a voltage detection signal, and determining, in response to determining based on the voltage detection signal that the voltage parameter of the indoor device satisfies a predetermined condition, the indoor device to be a wired controller 4.

Therefore, when the outdoor unit 1 is used to connect with the wired controller 4 through the switching control board 2, a voltage of the wired controller 4 can be detected by the voltage detection unit 22. In this case, the wired controller 4 and the voltage detection unit 22 cooperate with each other via a non-communication connection, such that an instruction for controlling the outdoor unit 1 can be flexibly generated by the switching control board 2 based on an operating mode, a pressure requirement and a startup signal of the wired controller 4, thereby controlling the outdoor unit 1. A voltage parameter of the wired controller 4 can be obtained by the voltage detection unit 22, and an operating parameter of the corresponding outdoor unit 1 can be determined based on the voltage parameter of the wired controller 4. For example, when the voltage detection unit 22 determines that the wired controller 4 is a 24V wired controller 4, the switching control board 2 can adaptively output an operating information instruction for controlling the outdoor unit 1 based on the 24V wired controller 4.

In some embodiments, as illustrated in FIG. 5, the action at block S30 of obtaining a corresponding control parameter based on the type of the indoor device includes the action at S31 of determining, when the indoor device is the wired controller 4, a target pressure based on a control instruction sent by the wired controller 4, detecting a current system pressure of the air conditioning system 100, and determining an operating parameter of the outdoor unit 1 based on the current system pressure and the target pressure.

Therefore, after it is determined that the indoor device is the wired controller 4, when the wired controller 4 and the switching control board 2 cooperate with each other via the non-communication connection, and when the key parameters of the indoor unit 3 such as the ambient temperature, set temperature, and wind speed cannot be obtained, the corresponding temperature requirement and mode requirement are inputted by the user through the control interface of the wired controller 4, and the corresponding mode requirement and capability requirement are outputted by the wired controller 4 to the switching control board 2 through control information transmission by means of connection wires. Thus, the target pressure of the air conditioning system 100 can be determined by the control module 24. In the meantime, a current operating pressure value of the air conditioning system 100 is detected. For example, a current system pressure of the air conditioning system 100 is obtained in real time by providing a pressure sensor, and the specific operating parameter such as the operating frequency required for achieving the target pressure of the outdoor unit 1 is calculated based on the parameter values of the two pressures.

Therefore, the current pressure of the system is detected by the pressure detection module, and the target pressure can be determined based on an outdoor environment and an energy demand of the wired controller 4. In addition, the target frequency is dynamically adjusted based on a difference between the target pressure and an actual pressure. In this way, the outdoor unit 1 can be accurately and appropriately controlled to guarantee that the operation of the outdoor unit 1 can meet the user' requirements for using.

In some embodiments, the switching control board 2 further includes an indoor communication unit 23, as illustrated in FIG. 5, the action at block S20 of detecting the type of the indoor device connected to the switching control board 2 includes the action at block S22 of: establishing, by the indoor communication unit, a communication connection between the switching control board 2 and the indoor device; receiving, based on the communication connection between the switching control board and the indoor device, communication information sent by the indoor device; and determining that the indoor device to be an indoor unit 3 based on the communication information.

Therefore, when the outdoor unit 1 is used to connect to the indoor unit 3 through the switching control board 2, the communication information of the indoor unit 3 can be obtained through the indoor communication unit 23 to determine that the indoor device is the indoor unit 3, thereby specifically determining how to control the outdoor unit 1. In this way, the instruction for controlling the outdoor unit 1 can be adaptively generated by the switching control board 2 based on the key parameters such as the ambient temperature, set temperature, and wind speed of the indoor unit 3 as well as the specification type of the indoor unit 3, thereby controlling of the outdoor unit 1.

In some embodiments, when the indoor device is the indoor unit 3, as illustrated in FIG. 5, the adaptive control method further includes the action at block S32 of: receiving an operating parameter of the outdoor unit 1 sent by the indoor unit 3 via the communication connection between the switching control board 2 and the indoor unit 3; and forwarding the operating parameter of the outdoor unit to the outdoor unit 1 via the communication connection between the switching control board 2 and the outdoor unit 1.

In the specific process of performing the action of block S30, the set information and the target frequency information of the indoor unit 3 can be outputted to the switching control board 2 through the indoor communication module 23. In some embodiments, the key parameters such as the startup and shutdown signals, target mode, and set indoor temperature can be outputted to the switching control board 2. Therefore, when the information interaction between the indoor unit 3 and the outdoor unit 1 is performed through the switching control board 2, the target operating parameter of the outdoor unit 1 can be outputted from the indoor unit 3 to the switching control board 2 through the indoor communication unit 23, and thus the target operating parameter of the outdoor unit 1 can be outputted from switching control board 2 to the outdoor unit 1 through the outdoor unit communication module 21. In this way, after the outdoor unit receives the target operating parameter, i.e., after the outdoor unit 1 is switched to the operating state that the outdoor unit 1 operates based on the target operating parameter, the accurate control of the outdoor unit 1 is realized.

Still yet another object of the present disclosure is to provide a computer-readable storage medium having stored thereon an adaptive control program for an air conditioning system 100. The adaptive control program for the air conditioning system 100, when executed by a processor, implements the adaptive control method for the air conditioning system according to any one of the embodiments described above.

Still yet another object of the present disclosure is to provide another switching control board 2. The switching control board 2 includes a memory, a processor, and an adaptive control program for an air conditioning system 100 stored in the memory and executable by the processor. The processor, when executing the adaptive control program for the air conditioning system 100, implements the adaptive control method for the air conditioning system according to any one of the embodiments described above.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples and features of different embodiments or examples described in the specification may be combined by those skilled in the art without mutual contradiction.

In addition, terms such as "first" and "second" are used herein for purposes of description and are not intended to indicate or imply relative importance or significance. Thus, the feature defined with "first" and "second" may comprise one or more this feature. In the description of the present disclosure, "a plurality of" means at least two, for example, two or three, unless specified otherwise.

Any process or method described in a flowchart or described herein in other ways can be understood to include one or more modules, segments or portions of codes of executable instructions for achieving specific logical functions or steps in the process, and the scope of a preferred embodiment of the present disclosure includes other implementations, which should be understood by those skilled in the art.

The logic and/or step described in other manners herein or illustrated in the flow chart, for example, a particular sequence table of executable instructions for realizing the logical function, may be specifically achieved in any computer readable medium to be used by the instruction execution system, apparatus or equipment (such as the system based on computers, the system comprising processors or other systems capable of obtaining the instruction from the instruction execution system, apparatus and equipment and executing the instruction), or to be used in combination with the instruction execution system, apparatus and equipment. Throughout the specification, "the computer readable medium" may be any apparatus configured to include, store, communicate, propagate or transfer programs to be used by or to be used in combination with the instruction execution system, apparatus or equipment. More specific examples of the computer readable medium include, but are not limited to: an electronic connection (an electronic device) with one or more wirings, a portable computer enclosure (a magnetic apparatus), a random-access memory (RAM), a read only memory (ROM), an erasable programmable read-only memory (EPROM or a flash memory), an optical fiber apparatus and a portable compact disk read-only memory (CDROM). In addition, the computer readable medium may even be a paper or other appropriate medium capable of printing programs thereon, since the paper or other appropriate medium may be, for example, optically scanned and then edited, decrypted or processed with other appropriate methods when necessary to obtain the programs in an electric manner, and then the programs may be stored in the computer memories.

It should be understood that each part of the present disclosure may be implemented in the form of hardware, software, firmware or their combination. In the above embodiments, a plurality of actions or methods may be implemented by the software or firmware stored in the memory and executed by the appropriate instruction execution system. For example, if they are implemented by the hardware, similar as that in another embodiment, the actions or methods can be implemented by one or a combination of the following known techniques: discrete logic circuit having a logic gate circuit for realizing a logic function of a data signal, application-specific integrated circuit having an appropriate combination logic gate circuit, a programmable gate array (PGA), a field programmable gate array (FPGA), etc.

Those skilled in the art can understand that all or a part of the steps of the method in the above-described embodiments may be implemented by relevant hardware instructed by a program. The program may be stored in a computer readable storage medium. When the program is executed, one or a combination of the steps of the method in the above-described embodiments can be implemented.

In addition, individual functional units in the embodiments of the present disclosure may be integrated in one processing module or may separately physically exist, or two or more units may be integrated in one module. The integrated module as described above may be implemented in the form of hardware or in the form of software functional module. If the integrated module is implemented in the form of software functional module and sold or used as a separate product, the integrated module may also be stored in a computer readable storage medium.

The above-mentioned storage medium may be read-only memories, magnetic disks or CD, etc. Although the embodiments of the present disclosure are illustrated and described above, it would be appreciated by those skilled in the art that the above embodiments cannot be construed as limitations of the present disclosure, and those skilled in the art can make changes, alternatives, and modifications to these embodiments without departing from scope of the present disclosure.

What is claimed is:

1. A switching control board comprising:

an outdoor unit communication module configured to establish a communication connection between the switching control board and an outdoor unit of an air conditioning system;

a detection module configured to detect a type of an indoor device of the air conditioning system that is connected to the switching control board; and a control module connected to the outdoor unit communication module and the detection module, the control module being configured to obtain a control parameter based on the type of the indoor device and send the control parameter to the outdoor unit via the communication connection between the switching control board and the outdoor unit to control the outdoor unit;

wherein the detection module includes a voltage detection unit configured to detect a voltage parameter of the indoor device to generate a voltage detection signal, and the detection module is configured to determine, in response to determining based on the voltage detection signal that the voltage parameter of the indoor device satisfies a predetermined condition, the indoor device to be a wired controller.

2. The switching control board according to claim 1, wherein:

the detection module further comprises:

an indoor communication unit configured to establish a communication connection between the switching control board and the indoor device, and the detection module is further configured to:

determine the indoor device to be an indoor unit based on communication information between the indoor communication unit and the indoor device.

3. The switching control board according to claim 1, wherein the control module is further configured to, in response to determining that the indoor device is the wired controller:

determine a target pressure based on a control instruction sent by the wired controller;

detect a current system pressure of the air conditioning system;

determine an operating parameter of the outdoor unit based on the current system pressure and the target pressure; and send the operating parameter of the outdoor unit to the outdoor unit via the communication connection between the switching control board and the outdoor unit.

4. The switching control board according to claim 2, wherein the control module is further configured to, in response to determining that the indoor device is the indoor unit:

receive, via the communication connection between the switching control board and the indoor unit, an operating parameter of the outdoor unit sent by the indoor unit; and forward the operating parameter of the outdoor unit to the outdoor unit via the communication connection between the switching control board and the outdoor unit.

5. An air conditioning system comprising:

an outdoor unit;

an indoor device;

a switching control board connected to the indoor device and including:

an outdoor unit communication module configured to establish a communication connection between the switching control board and the outdoor unit;

a detection module configured to detect a type of the indoor device; and a control module connected to the outdoor unit communication module and the detection module, the control module being configured to obtain a control parameter based on the type of the indoor device and send the control parameter to the outdoor unit via the communication connection between the switching control board and the outdoor unit to control the outdoor unit;

wherein the detection module includes a voltage detection unit configured to detect a voltage parameter of the indoor device to generate a voltage detection signal, and the detection module is configured to determine, in response to determining based on the voltage detection signal that the voltage parameter of the indoor device satisfies a predetermined condition, the indoor device to be a wired controller.

6. The air conditioning system according to claim 5, wherein:

the detection module further comprises:

an indoor communication unit configured to establish a communication connection between the switching control board and the indoor device, and the detection module is further configured to:

determine the indoor device to be an indoor unit based on communication information between the indoor communication unit and the indoor device.

7. The air conditioning system according to claim 5, wherein the control module is further configured to, in response to determining that the indoor device is the wired controller:

determine a target pressure based on a control instruction sent by the wired controller;

detect a current system pressure of the air conditioning system;

determine an operating parameter of the outdoor unit based on the current system pressure and the target pressure; and send the operating parameter of the outdoor unit to the outdoor unit via the communication connection between the switching control board and the outdoor unit.

8. The air conditioning system according to claim 6, wherein the control module is further configured to, in response to determining that the indoor device is the indoor unit:

receive, via the communication connection between the switching control board and the indoor unit, an operating parameter of the outdoor unit sent by the indoor unit; and forward the operating parameter of the outdoor unit to the outdoor unit via the communication connection between the switching control board and the outdoor unit.

9. An adaptive control method comprising:

establishing, by an outdoor unit communication module of a switching control board, a communication connection between the switching control board and an outdoor unit of an air conditioning system;

detecting a type of an indoor device of the air conditioning system that is connected to the switching control board, including:

detecting a voltage parameter of the indoor device to generate a voltage detection signal; and determining, in response to determining based on the voltage detection signal that the voltage parameter of the indoor device satisfies a predetermined condition, the indoor device to be a wired controller;

obtaining a control parameter based on the type of the indoor device; and sending the control parameter to the outdoor unit via the communication connection between the switching control board and the outdoor unit, to control the outdoor unit.

10. The adaptive control method according to claim 9, wherein obtaining the control parameter based on the type of the indoor device includes, in response to determining that the indoor device is the wired controller:

determining a target pressure based on a control instruction sent by the wired controller;

detecting a current system pressure of the air conditioning system; and determining an operating parameter of the outdoor unit based on the current system pressure and the target pressure.

11. The adaptive control method according to claim 9, wherein detecting the type of the indoor device further includes:

establishing, by an indoor communication unit of the switching control board, a communication connection between the switching control board and the indoor device;

receiving, based on the communication connection between the switching control board and the indoor device, communication information sent by the indoor device; and determining the indoor device to be an indoor unit based on the communication information.

12. The adaptive control method according to claim 11, further comprising, in response to determining that the indoor unit is the indoor unit:

receiving, via the communication connection between the switching control board and the indoor unit, an operating parameter of the outdoor unit sent by the indoor unit; and forwarding the operating parameter of the outdoor unit to the outdoor unit via the communication connection between the switching control board and the outdoor unit.

13. A non-transitory computer-readable storage medium storing an adaptive control program that, when executed by a processor, causes the processor to implement the adaptive control method according to claim 9.

14. A switching control board comprising:

a memory storing an adaptive control program; and a processor configured to execute the adaptive control program to implement the adaptive control method according to any claim 9.

* * * * *